United States Patent [19]

Shibuya et al.

[11] Patent Number: 5,047,284

[45] Date of Patent: Sep. 10, 1991

[54] THERMAL TRANSFER RECORDING SHEET

[75] Inventors: Kiyoshi Shibuya; Toshihiko Matsushita, both of Tokyo; Sadao Morishita, Ushiku, all of Japan

[73] Assignee: Mitsubishi Paper Mills Limited, Tokyo, Japan

[21] Appl. No.: 336,130

[22] Filed: Apr. 11, 1989

[30] Foreign Application Priority Data

Apr. 15, 1988 [JP] Japan ..... 63-93163

[51] Int. Cl.[5] ..... B41M 5/26

[52] U.S. Cl. ..... 428/216; 428/195; 428/212; 428/480; 428/483; 428/500; 428/913; 428/914

[58] Field of Search ..... 428/488.1, 488.4, 913, 428/914, 483, 515, 516, 195, 212, 215, 216, 480, 500

[56] References Cited

U.S. PATENT DOCUMENTS 4,877,681 10/1989 Hanada .

FOREIGN PATENT DOCUMENTS

| | | | |
|---|---|---|---|
| 3808462A1 | 3/1988 | Fed. Rep. of Germany | 428/195 |
| 56-164891 | 12/1981 | Japan | 428/488.4 |
| 101083 | 11/1983 | Japan | 428/488.4 |
| 101084 | 11/1983 | Japan | 428/488.4 |

OTHER PUBLICATIONS

English Language Text of JIS Z 8741 Method of Measurement for Specular Glossiness.

*Primary Examiner*—Pamela R. Schwartz

*Attorney, Agent, or Firm*—Cushman, Darby & Cushman

[57] ABSTRACT

The present invention provides a thermal transfer recording sheet which can form a matte and glossless image high in quality on an image receiving sheet. This thermal transfer recording sheet comprises a support and an undercoating layer comprising a heat-meltable olefin resin and a heat-meltable ink layer laminated in succession on one side of said support wherein difference in melting point of the undercoating layer and that of the heat-meltable ink layer is 20° C. or less and the undercoating layer and the heat-meltable ink layer mix with each other and melt in the vicinity of interface therebetween after coating of these layers. The thickness of the under coating layer is preferably 0.5–5.0 μm.

4 Claims, 1 Drawing Sheet

THERMAL TRANSFER RECORDING SHEET

BACKGROUND OF THE INVENTION

1. Field of the Invention

The present invention relates to a thermal transfer recording sheet which produces glossless and matte impressions.

2. Discussion on Related Art

Recently, extensive development has been made on thermal transfer recording which forms a transferred image on a plain paper by a thermal printer or thermal facsimile. This thermal transfer recording is recently widely used because mechanism of device is simple and its maintenance is easy and besides price and maintenance cost of device are low; clear and fast recording can be performed with low energy; and color printing is relatively easy by using multi-color ink sheets. Especially, use of thermal transfer recording sheet of monochromatic type is increased owing to spread of thermal printer for word processors and thermal facsimile.

However, images recorded by thermal printer are generally high in gloss. In multi-color recording, not only definition of recording, but also aesthetic quality are required as in the fields of graphic design and full color copying and these characteristics greatly contribute to gloss of image.

On the other hand, recording of monochromatic type is mainly used in the fields of recording or copying of letters. In this case, when people read the impressed images, they feel great eye fatigue with increase of gloss of the images. This is one of the problems to be improved in thermal transfer recording. That is, glossless matte impressions are strongly demanded in thermal transfer recording of monochromatic type.

There are many known techniques of thermal transfer recording which provides glossless matte impressions.

Japanese Patent Kokai No. 60-101084 discloses a method according to which the surface to be provided with a heat-meltable ink layer of a base film is matted by sandblasting or by film molding with incorporation of fine particles.

Further, Japanese Patent Kokai No. 56-164891 discloses incorporation of a matting agent into a heat-meltable heat-sensitive ink.

Moreover, Japanese Patent Kokai No. 60-101083 discloses to provide a matting layer on a base film.

However, the methods disclosed in these patent publications suffer from various problems.

For example, the method of sandblasting the surface of a base film has the defects of reduction in strength of the film and high cost. The method of molding the film with incorporation of fine particles has the defect that degree of matting cannot be increased unless the fine particles are incorporated in a large amount.

The method of incorporating a matting agent into ink has the defects that since the matting agent is ordinarily a white inorganic pigment, matting effect is difficult to exhibit with addition of the matting agent in a small amount while addition of the matting agent in a large amount causes deterioration in quality of impressions and decrease in transfer density.

Furthermore, the method of providing a matting layer on a base film has the defects that the ink of the matting layer comprises a binder and an inorganic pigment and in order to exhibit matting effect, it is necessary to increase matting depth in the matting layer and thus it becomes necessary to increase particle size of the inorganic pigment or to use the inorganic pigment in a large amount.

SUMMARY OF THE INVENTION

The object of the present invention is to provide a thermal transfer recording sheet which can give glossless matte impressions and which is free from the above-mentioned defects.

That is, the thermal transfer recording sheet provided by the present invention comprises a support, an undercoating layer of an olefin resin coated on one side of the support and a heat-meltable ink layer coated on said undercoating layer wherein difference in melting point of the undercoating layer and that of the heat-meltable ink layer is 20° C. or less and besides the undercoating layer and the heat-meltable ink layer mix with each other in molten state in the vicinity of interface between these two layers after coated.

The thermal transfer sheet of the present invention is further characterized in that at least one resin selected from the group consisting of polyethylene, polypropylene and polybutene is used as the olefin resin which is a material of the undercoating layer and the undercoating layer is coated at a thickness of 0.5–5 μm, preferably 1.0–3.0 μm on one side of the support.

BRIEF DESCRIPTION OF DRAWINGS

In FIG. 1 a heat resistant layer is provided on another side of the support and in FIG. 2, said heat resistant layer is not provided. In FIG. 3, matte images are impressed in accordance with the present invention. In FIG. 4, conventional gloss images are impressed.

DETAILED DESCRIPTION OF THE PREFERRED EMBODIMENTS

Figure 1:
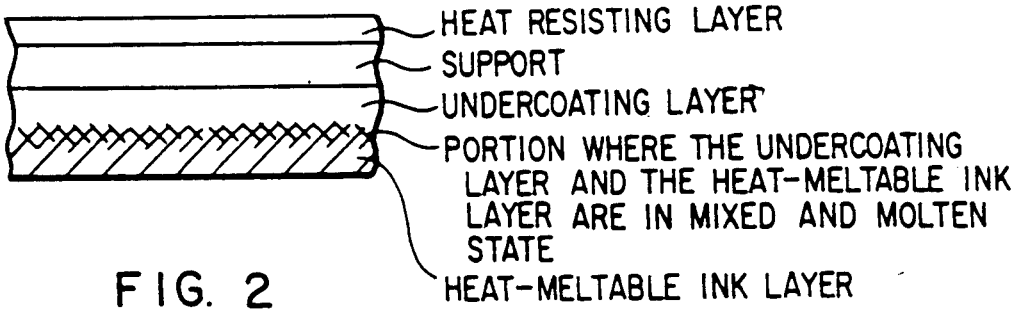
FIGS. 1 and 2 are schematic illustrations in cross-section of thermal transfer recording sheets constructed in accordance with the present invention.
Figure 2:
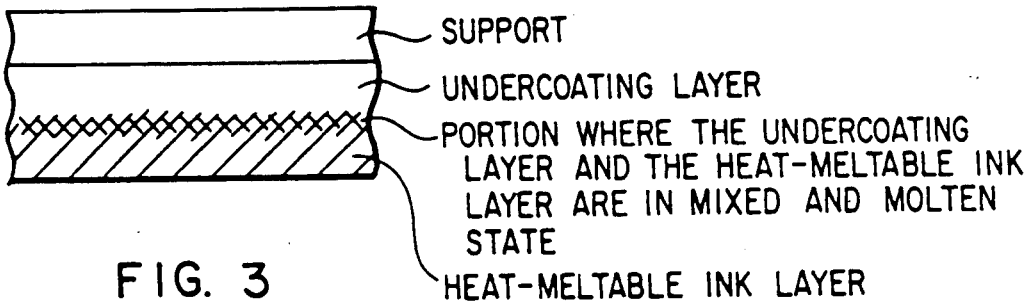
Figure 3:
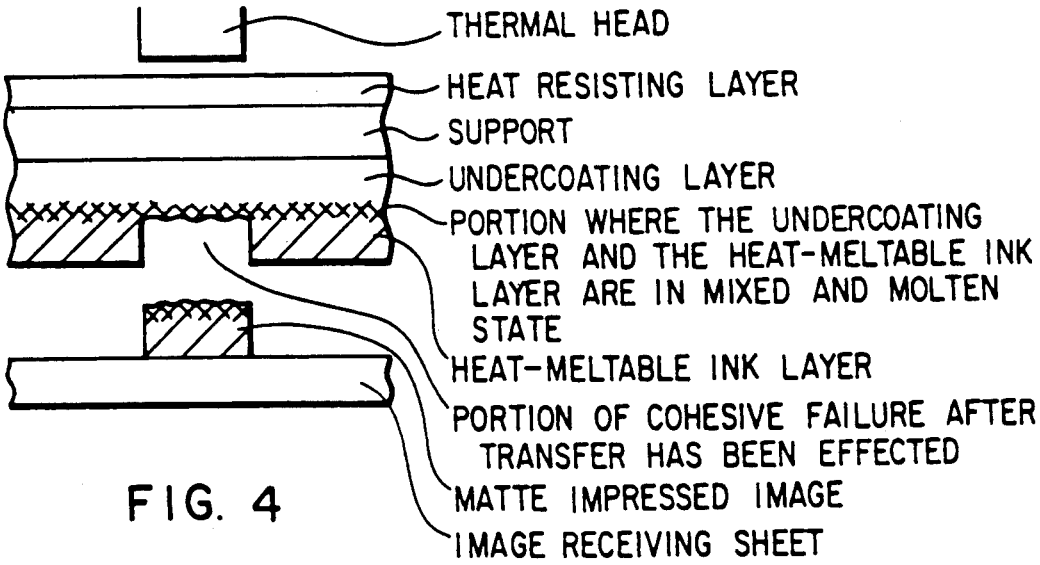
FIGS. 3 and 4 are schematic illustrations of transfer to an image receiving sheet by a thermal head.
Figure 4:
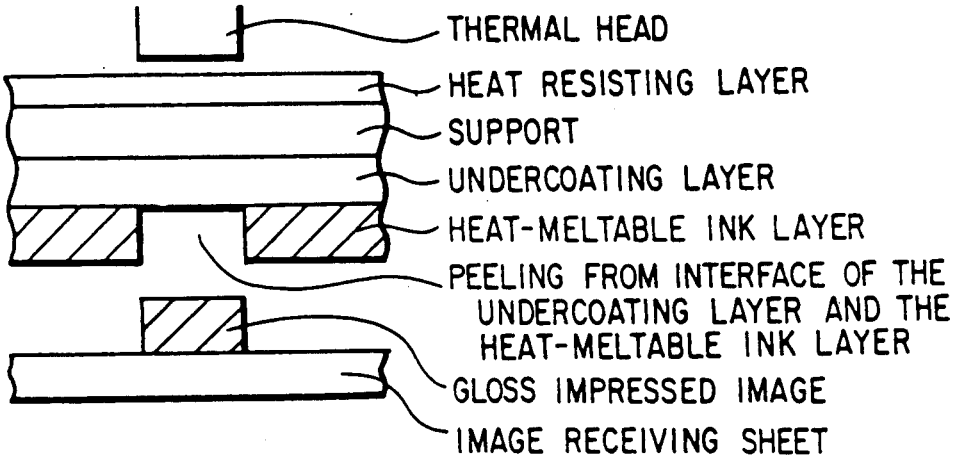

The thermal transfer recording sheet of the present invention has two-layer structure comprising an undercoating layer provided on one side of a support and a heat-meltable ink layer provided on said undercoating layer. The thermal transfer sheet is superimposed upon an image receiving sheet so that the heat-meltable ink layer of the support contacts with the receiving sheet and the assembly is applied with localized heat from the side of the support opposite the coating layers by a thermal head, thus forming a transferred image on the image receiving sheet.

In this case, it is necessary that the undercoating layer and the heat-meltable ink layer differ in melting point by 20° C. or less and thus the portion of interface between these layers is in mixed and molten state and definite layer structure is not present. For this purpose, it is essential that the difference in melting point of the resin of the undercoating layer and that of the heat-meltable ink is 20° C. or less. By forming such construction, separation occurs at the undercoating layer side or the heat-meltable ink layer side at the interface thereof upon impression. In more detail, adhesion between the undercoating layer and the support is sufficiently great before impression, but by controlling adhesion between heat-meltable ink and the surface of sheet upon application of heat or internal cohesive force of the undercoating layer and the heat-meltable ink layer, peeling (cohesive failure) of the heat-meltable ink occurs from the undercoating layer side or the heat-meltable ink layer side in the vicinity of interface between these layers upon impression resulting in transfer of a matte image onto the image receiving sheet.

As mentioned above, in the thermal transfer recording sheet of the present invention, the heat-meltable ink is peeled from either the undercoating layer side or the heat-meltable ink layer side in the vicinity of the interface therebetween at the time of thermal transfer and is transferred onto an image receiving sheet and thus the portions of the thermal transfer recording sheet applied with heat, namely, the peeled portion has irregularity on the surface, namely, a roughened surface and as a result a matte transfer image of low gloss can be obtained.

That is, the object of the present invention is to cause peeling (cohesive failure) of the heat-meltable ink in the vicinity of interface between the undercoating layer and the heat-meltable ink layer from either the undercoating layer side or the heat-meltable ink layer side. Thereby, a good matte transfer image can be obtained.

The thermal transfer recording sheet is superimposed on an image receiving sheet and is applied with heat impression by a thermal head to form a transfer image on the image receiving sheet simultaneously with the heat-meltable ink being melted to permeate or adhere to the surface of the image receiving layer. After impression with heat, the thermal transfer recording sheet is peeled from the image receiving layer. In this case, peeling occurs at either the undercoating layer side or the heat-meltable ink layer side in the vicinity of interface of these layers and as a result the heat impressed portion, namely, peeled portion (where cohesive failure has occurred) of the thermal transfer recording sheet has irregular surface, so-called roughened surface, whereby the surface of the impressed image is matted.

For the above reason, the thermal transfer recording sheet of the present invention can afford the objective so-called matte impressed image low in gloss.

Materials used for the thermal transfer recording sheet of the present invention will be explained below.

As the supports, mention may be made of thin paper, synthetic paper and cellophane paper such as capacitor paper, typewriter paper and tracing paper, and synthetic resin films such as polyester film, polyimide film, polyethylene film, polycarbonate film and Teflon film. These may be used as such or subjected to heat resisting treatment to prevent sticking to thermal head. Especially preferred is a polyester film.

The ink used for the heat-meltable ink layer comprises a heat-meltable substance, a colorant, a binder, a softening agent and the like and can be suitably used depending on necessity.

As the heat-meltable substances, there may be used waxes, metal soaps, and resins and typical examples thereof which are not limitative are as follows:

Waxes: Vegetable waxes such as rice wax, Japan wax, candelilla wax, and carnauba wax; animal waxes such as lanolin, beeswax, spermaceti and shellac wax; mineral waxes such as montanic wax, ozokerite, and ceresin; petroleum waxes such as paraffin wax and microcrystalline wax; synthetic hydrocarbon waxes such as oxidized paraffin wax and low molecular polyethylene; fatty acid amide waxes such as ricinolic acid amide, lauric acid amide, erucic acid amide, palmitic acid amide, oleic acid amide, stearic acid amide, and ethylenebisstearic acid amide.

Metallic soaps: Metal salts of higher fatty acids such as sodium stearate, sodium palmitate, potassium laurate, potassium myristate, calcium stearate, zinc stearate, aluminum stearate and magnesium stearate.

Resins: Polyamide resins, polyester resins, epoxy resins, polyurethane resins, polyacryl resins, polyvinyl resins, polyvinylchloride resins, cellulose resins, polyvinyl alcohol resins, petroleum resins, terpene resins, polystyrene resins, polyolefin resins and elastomers.

The colorants include dyes and pigments such as oil-soluble dyes, disperse dyes and colored pigments, which are optionally used depending on use. Typical examples thereof which are not limitative are enumerated below. These may be used alone or in combination of two or more.

Oil-soluble dyes include azo dyes, azo metal complex dyes, anthraquinone dyes and phthalocyanine dyes. Typical examples thereof are Solvent Yellow 2 (C.I.11020), Solvent Orange 1 (C.I.11920), Solvent Red 24 (C.I.26105) and Solvent Brown 3 (C.I.11360) as azo dyes; Solvent Yellow 19 (C.I.13900A), Solvent Orange 5 (C.I.18745A), Solvent Red 8 (C.I.12715), Solvent Brown 37, and Solvent Black 123 (C.I.12195) as azo metal complex dyes; Solvent Violet 13 (C.I.60725), Solvent Blue 11 (C.I.61525), and Solvent Green 3 (C.I.61565) as anthraquinone dyes; and Solvent Blue 25 (C.I.74350) as phthalocyanine dyes.

Disperse dyes include aminoazo or aminoanthraquinone dyes and nitroarylamine dyes. Typical examples thereof are Disperse Yellow 3 (C.I.11855), Disperse Orange 3 (C.I.11005), Disperse Red 1 (C.I.11110), Disperse Violet 24 (C.I.11200) and Disperse Blue 44 as aminoazo dyes; Disperse Orange 11 (C.I.60700), Disperse Red 4 (C.I.60755), Disperse Violet 1 (C.I.61100) and Disperse Blue 3 (C.I.61505) as aminoanthraquinone dyes; and Disperse Yellow 1 (C.I.10345) and 42 (C.I.10338) as nitroarylamine dyes.

Colored pigments include azo pigments (monoazo, bisazo and condensed azo pigments), color lake pigments (acid dye lake, basic dye lake, and mordant dye lake pigments), nitro pigments, nitroso pigments, phthalocyanine pigments, higher grade pigments (vat dye pigments, metal complex pigments, perylene pigments, isoindolinone pigments and quinacridone pigments). Typical examples thereof are as follows: Azo pigments such as Hansa Yellow G (C.I.11680), Hansa Yellow R (C.I.12710), Pyrazolone Red B (C.I.21120), Permanent Red R (C.I.12085), Lake Red C (C.I.15585), Brilliant Carmine 6B (C.I.15850), and Permanent Carmine FB (C.I.12490) (as monoazo pigments), Benzidine Yellow G (C.I.21090), Benzidine Yellow GR (C.I.21100) and Permanent Yellow NCR (C.I.20040) (as bisazo pigments), and Chromophthal Yellow and Chromophthal Red (as condensed azo pigments); color lake pigments such as Quinoline Yellow Lake (C.I.47005), Eosine Lake (C.I.45380) and Alkali Blue Lake (C.I.42750A, 42770A) (as acid dye lake pigments), Rhodamine Lake B (C.I.45170), Methyl Violet Lake (C.I.42535), Victoria Blue Lake (C.I.44045) and Malachite Green Lake (C.I.42000) (as basic dye lake pigments) and Alizarin Lake (C.I.58000) (as mordant dye lake pigments); nitro pigments such as Naphthol Yellow S (C.I.10316); nitroso pigments such as Pigment Green B (C.I.10006) and Naphthol Green B (C.I.10020); phthalocyanine pigments such as metal-free Phthalocyanine Blue (C.I.74100), Phthalocyanine Blue (C.I.74160) and Phthalocyanine Green (C.I.74260); and high grade pigments such as Anthrapyrimidine Yellow (C.I.68420), Indanthrene Brilliant Orange GK (C.I.59305), Indanthrene Blue RS (C.I.69800) and Thioindigo Red B (C.I.73300) (as vat dye pigments), Nickel Azo Yellow (C.I.12775) (as metal complex pigments), Perylene Red (C.I.71140) and Perylene Scarlet (C.I.71137) (as perylene pigments), Isoindolinone Yellow (as isoindolinone pigments), Quinacridone Red Y (C.I.46500) and Quinacridone Magenta (C.I.73915).

Black pigments include Carbon Black (C.I.77265).

As the binders, there may be used any of water-soluble binders and non-water-soluble binders.

The nonlimiting examples of the binders are enumerated below.

Polyvinyl alcohol, methylcellulose, gelatin, hydroxyethylcellulose, carboxymethylcellulose, gum arabic, starch and its derivatives, casein, polyvinylpyrrolidone, butyral resin, ethylene-ethyl acrylate copolymer, styrene-butadiene copolymer, vinyl acetate resin, vinyl acetate copolymers, acrylic resin, methyl methacrylate resin, styrene-acrylonitrile resin, ethylene-vinyl acetate copolymer, polyester resin, and petroleum resins.

The softening agents used include, for example, mineral oil, dibutyl phthalate, dioctyl phthalate, mineral spirit, and liquid paraffin.

In addition to the heat-meltable substance, the colorant, the binder, and the softening agent, the ink may further contain, for example, surfactants, dispersants, antistatic agents, antioxidants, and ultraviolet absorbers.

As examples of the olefin resin used as undercoating layer, mention may be made of α-olefin resins including copolymers. Especially preferred are polyethylene, polypropylene and polybutene.

As coating machines used for coating the undercoating layer and the heat-meltable ink layer on a support in the thermal transfer recording sheet of the present invention, mention may be made of, for example, known coaters such as hot melt coater, air knife coater, roll coater, blade coater and bar coater and, furthermore, known printers such as those used in flexographic printing and gravure printing.

For solvent coating, there may be used general solvents such as methanol, ethanol, isopropyl alcohol, toluene, methyl ethyl ketone, acetone and ethyl acetate.

Thickness of the undercoating layer is 0.5–5.0 μm, preferably 1.0–3.0 μm.

Thickness of the heat-meltable ink layer coated on the undercoating layer is 1–15 μm, preferably 2–10 μm, more preferably 3–6 μm.

The thermal transfer recording sheet of the present invention is characterized by comprising a support and an undercoating layer of an olefin resin and a heat-meltable ink layer coated in succession on one side of the support.

The thermal transfer recording sheet has the effect that a matte impressed image of low gloss can be obtained on an image receiving sheet.

The present invention is further explained by the following examples where "part" is based on weight.

EXAMPLE 1

A polyester film of 5.2 μm thick was coated on one side with a heat resisting layer. Another side of the film was coated with an undercoating layer comprising an olefin resin at a thickness of 1.5 μm by a roll coater. An emulsion of polyethylene having a melting point of 93° C. was used as the olefin resin.

Subsequently, on the undercoating layer was coated an aqueous heat-meltable ink (melting point 78° C.) of the following formulation as a heat-meltable ink layer at a thickness of 4 μm by a bar coater to obtain a thermal transfer recording sheet.

| | |
|---|---|
| Carbon black | 13 parts |
| Ethylene-vinyl acetate copolymer | 5 parts |
| Petroleum resin | 10 parts |
| Polyethylene wax | 72 parts |

This thermal transfer recording sheet was superimposed upon an image receiving paper for thermal transfer recording (Trade name: TTR-T manufactured by Mitsubishi Paper Mills Ltd.) and letter impression and solid impression were made at 1.3 mJ/dot by a thermal head printing apparatus manufactured by Matsushita Electronic Parts Co. to obtain a clear and matte image on the image receiving sheet. Results of evaluation of the image are shown in Table 1.

EXAMPLE 2

A thermal transfer recording sheet was produced in the same manner as in Example 1 except that an emulsion of polypropylene having a melting point of 67° C. was coated as the undercoating layer at a thickness of 2 μm by a roll coater.

Impression was made in the same manner as in Example 1. Results of evaluation are shown in Table 1.

EXAMPLE 3

A thermal transfer recording sheet was produced in the same manner as in Example 1 except that a mixture (melting point 90° C.) of the same polyethylene as used in Example 1 and a polyester resin having a melting point of 83° C. at 2:1 was coated as the undercoating layer at a thickness of 1.5 μm by a hot melt coater. Then, impression was made in the same manner as in Example 1. Results of evaluation are shown in Table 1.

EXAMPLE 4

A thermal transfer recording sheet was produced in the same manner as in Example 1 except that a mixture (melting point 89° C.) of the same polyethylene as used in Example 1 and an ethylene-vinyl acetate copolymer (melting point 78° C.) at 3:1 was coated as the undercoating layer at a thickness of 1.5 μm by a hot melt coater. Then, impression was made in the same manner as in Example 1. Results of evaluation are shown in Table 1.

COMPARATIVE EXAMPLE 1

A thermal transfer recording sheet was produced in the same manner as in Example 1 except that an emulsion of polyethylene having a melting point of 130° C. was coated as the undercoating layer at a thickness of 1.5 μm by a roll coater.

Impression was made in the same manner as in Example 1. Results of evaluation are shown in Table 1.

COMPARATIVE EXAMPLE 2

A thermal transfer recording sheet was produced in the same manner as in Example 1 except that an acrylic resin having a melting point of 65° C. was coated as the undercoating layer at a thickness of 1.5 μm by a hot melt coater.

Impression was made in the same manner as in Example 1. Results of evaluation are shown in Table 1.

COMPARATIVE EXAMPLE 3

A thermal transfer recording sheet was produced in the same manner as in Example 1 except that the undercoating layer was omitted, namely, only the heat-meltable ink was coated on the support. Impression was made in the same manner as in Example 1. Results of evaluation are shown in Table 1.

COMPARATIVE EXAMPLE 4

A thermal transfer recording sheet was produced in the same manner as in Example 1 except that the same polyethylene having a melting point of 93° C. as used in Example 1 was coated as the undercoating layer at a thickness of 6 μm by a bar coater.

Impression was made in the same manner as in Example 1. Results of evaluation are shown in Table 1.

COMPARATIVE EXAMPLE 5

A thermal transfer recording sheet was produced in the same manner as in Example 1 except that emulsion of the polyethylene having a melting point of 93° C. as used in Example 1 was coated as the undercoating layer at a thickness of 0.2 μm by a gravure coater.

Impression was made in the same manner as in Example 1. Results of evaluation are shown in Table 1.

Methods of evaluation (1) Evaluation of gloss

Gloss at 60° specular gloss as specified in JIS Z8741 was measured by a gloss meter (Trade name: ND-1001DP manufactured by Nihon Denshoku Kogyo Co.).

(2) Impression properties

Letter impression and solid impression were made on an image receiving paper for thermal transfer recording (Trade name: TTR manufactured by Mitsubishi Paper Mills Ltd.) at an impression energy of 1.3 mJ/dot by a thermal head printing apparatus manufactured by Matsushita Electronic Parts Co. and the impressed images were evaluated by visual observation.

(3) Adhesion to support

Thermal transfer recording sheet was crumpled by hands ten times and degree of peeling of the undercoating layer and the heat-meltable ink layer from the support was visually evaluated.

TABLE 1

| | Gloss | Impression properties | Adhesion to support |
|---|---|---|---|
| Example 1 | 8.4 | ○ | Δ |
| Example 2 | 21.3 | ○ | ○ |
| Example 3 | 13.8 | ○ | ○ |
| Example 4 | 18.5 | ○ | ○ |
| Comparative Example 1 | 54.7 | Δ | Δ |
| Comparative Example 2 | 62.3 | Δ | X |
| Comparative Example 3 | 67.4 | Δ | ○ |
| Comparative Example 4 | 34.5 | X | X |
| Comparative Example 5 | 60.0 | Δ | ○ |

TABLE 1-continued

Gloss: 60° specular gloss specified in JIS Z8741
Impression properties:
○: Clear impressed image free from ink-missing or blurs
Δ: Slight ink-missing of image and blurs were recognized.
X: Much ink-missing of image and many blurs were recognized (transfer was inferior).
Adhesion to support:
○: Excellent in adhesion to support
Δ: Somewhat inferior in adhesion to support
X: The layer was readily peeled from support The thermal transfer recording sheet of Example 1 was somewhat inferior in adhesion of layer to support, but gave a clear and matte image. The thermal transfer recording sheet of Example 2 was superior in adhesion to support and besides gave a clear and matte image. The thermal transfer recording sheets of Examples 3 and 4 were superior in adhesion of layer to support and besides gave clear and matte images by using the polyethylene used in Example 1 in combination with polyester resin and ethylene-vinyl acetate copolymer, respectively.

The mixed and molten state was not formed in the vicinity of interface between the undercoating layer and the heat-meltable ink layer in the thermal transfer recording sheet obtained in Comparative Example 1 where polyethylene differing from heat-meltable ink layer in melting point by more than 20° C. was used as material for the undercoating layer and the thermal transfer recording sheet obtained was inferior in adhesion of layer to support and impression properties and gave a gloss image. The thermal transfer recording sheet obtained in Comparative Example 2 where an acrylic resin was used as material for the undercoating layer was inferior in adhesion of layer to support and impression properties and gave a gloss image.

The thermal transfer recording sheet obtained in Comparative Example 3 which had only the heat-meltable ink layer was superior in adhesion of layer to support, but somewhat inferior in impression properties and gave a gloss image. The thermal transfer recording sheet obtained in Comparative Example 4 where the polyethylene used in Example 1 as the undercoating layer was coated at a thickness of 6 μm was inferior in adhesion of layer to support and impression properties and besides gave a gloss image. The thermal transfer recording sheet obtained in Comparative Example 5 where the polyethylene used in Example 1 was coated at a thickness of 0.2 μm was insufficient in cohesive failure in the vicinity of the interface at application of heat and besides gave a gloss image.

As explained above, the thermal transfer recording sheet of the present invention gives matte impressed images with low gloss. Thus, the present invention is very high in industrial value.

What is claimed is:

1. A thermal transfer recording sheet which comprises a support, an undercoating layer comprising a heat-meltable olefin resin, and a heat-meltable ink layer laminated in succession on one side of said support, wherein the thickness of the undercoating layer is 0.5 to 5 μm, and wherein the heat meltable ink layer has a thickness of 1 to 15 μm, the difference in melting point of the under-coating layer and that of the heat-meltable ink layer being 20 C. or less, and wherein the application of the heat-meltable ink layer to the undercoating layer results in said layers being mixed with each other in the vicinity of the interface therebetween after being coated on the support.

2. A thermal transfer recording sheet according to claim 1 wherein the olefin resin is at least one resin selected from the group consisting of polyethylene resin, polypropylene resin and polybutene resin.

3. A thermal transfer recording sheet according to claim 1 wherein the thickness of the undercoating layer is 1.0–3.0 μm.

4. A thermal transfer recording sheet according to claim 1 wherein the support is a polyester film.

* * * * *